US005277631A

United States Patent [19]

Henmi

[11] Patent Number: 5,277,631

[45] Date of Patent: Jan. 11, 1994

[54] VANE ARRANGEMENT FOR A WATER JET PROPULSION ASSEMBLY

[75] Inventor: Yasuhiko Henmi, Shizuoka, Japan

[73] Assignee: Sanshin Kogyo Kabushiki Kaisha, Japan

[21] Appl. No.: 960,803

[22] Filed: Oct. 14, 1992

[30] Foreign Application Priority Data

Oct. 14, 1991 [JP] Japan ..... 3-293741

[51] Int. Cl.[5] ..... B63H 11/103

[52] U.S. Cl. ..... 440/47; 60/221

[58] Field of Search ..... 440/38, 47; 415/208.1, 415/209.1, 209.4, 210.1, 214.1; 60/221

[56] References Cited

U.S. PATENT DOCUMENTS 3,083,529 4/1963 Hamilton ..... 440/38
3,328,961 7/1967 Aschauer ..... 440/47
3,389,558 6/1968 Hall ..... 60/221

FOREIGN PATENT DOCUMENTS 60-30599 7/1985 Japan .

*Primary Examiner*—Jesus D. Sotelo
*Attorney, Agent, or Firm*—Bacon & Thomas

[57] ABSTRACT

A water jet propulsion assembly for a jet ski-type watercraft includes an annular duct including a first section within which an impeller is located, a second section having a group of sloping vane members extending radially therethrough and a third section formed with a group of straight vane member extending partially radially inwardly from the inside surface of the outermost duct wall. The duct terminates in a nozzle for expelling water flowing therethrough. The second section of the duct includes radially inner and outer wall portions and the inner portion has a cap member secured to a rear end thereof. The cap member extends into the third duct section and is formed with another group of straight vane member which extend radially outwardly. The vane members function to convert the swirling water flow created by the impeller into a linear flow that is directed through the nozzle. The sloping and straight vane members are divided to permit more efficient molding of the vane sections by die casting.

7 Claims, 6 Drawing Sheets

PRIOR ART

VANE ARRANGEMENT FOR A WATER JET PROPULSION ASSEMBLY

BACKGROUND OF THE INVENTION

1. Field of the Invention

The present invention pertains to a water jet propulsion assembly and, more particularly, a stationary vane arrangement for directing the pressurized flow of water from an impeller of a water jet propulsion unit.

2. Discussion of the Prior Art

A jet ski-type watercraft utilizes a water jet propulsion unit located in a concave area formed in a lower, stern portion of the watercraft to propel the watercraft. As shown in FIG. 1, a typical prior art water jet propulsion unit draws water in through an opening 38A formed in the hull of the boat. This water is pressurized by an impeller 30A which is rotated by an engine (not shown) through a shaft 16A. The pressurized water is then expelled rearward through a nozzle 40A. A duct structure 26A defined by an outer duct tube 20A and an inner duct tube 24A defines a water passage 36A for the pressurized water flowing toward nozzle 40A. Stationary vanes 23A, formed integral with duct 26A and extending radially inward therefrom, function to convert the swirling water flow from impeller 30A to a linear flow and to direct the water to nozzle 40A.

In order for stationary vanes 23A to be able to convert the swirling water flow into a linear flow, stationary vanes 23A must be colinear with the axial direction of drive shaft 16A. As best shown in FIG. 3, which is a cross-sectional view taken along line III—III of the stationary vane 23A shown in FIG. 2, each stationary vane 23A comprises a sloping portion 50A and a straight portion 52A. Sloping portion 50A comprising roughly half the length of vane 23A, is located on the impeller side of duct 26A and slopes in a direction opposite that of impeller 30A. Straight portion 52A of stationary vane 23A extends axially toward the nozzle end of duct 26A. This type of duct arrangement for a jet ski-type watercraft is exemplified by Japan Patent Sho 60-30599.

In this known jet ski propulsion arrangement, duct 26 A, along with stationary vanes 23A, is produced by aluminum die casting in order to improve productivity and to reduce manufacturing costs. However, since the stationary vanes 23A have sloping portions 50A, the fabrication has to be accomplished using a split mold, as depicted at 80A, 82A in FIG. 3, in order to cast duct 26A having stationary vanes 23A. This makes it necessary for each of the mold pieces to be removed in the directions of arrows 70A, 72A of FIG. 3. However, when stationary vanes 23A are made relatively long, the mold removal distance lengthens correspondingly. When this is done, as shown in FIGS. 2 and 4, a step 60B is formed on the outside circumference of the inner duct tube 24A along with a step 60A on the inside circumference of outer duct tube 20A. These steps 60A, 60B formed at the junction of the mold sections tend to disturb the water flow by creating turbulents and decrease the propulsion efficiency of the water jet propulsion unit.

Therefore, there exists a need in the art for a water jet propulsion assembly which can be die casted with minimal step differentials and which includes a water flow duct having radial vanes which enables a generally linear flow of water through the duct so as to increase the efficiency of the propulsion assembly.

SUMMARY OF THE INVENTION

The present invention provides a water jet propulsion assembly including an impeller which pressurizes water taken in through an opening, a duct defining a water passage, stationary vanes which rectify the flow of water from the impeller through the duct and a nozzle through which the rectified water flow is expelled. The stationary vanes are comprised of sloping members and straight members which are formed separately from one another.

By separately forming the slope and straight vane members, which combine to convert the pressurized water flow from the impeller into a linear flowing medium, it is possible to dramatically shorten the distance through which mold sections used to form the vanes have to be withdrawn from the casting. This dramatically reduces the size of steps which inherently form at the juncture of the mold sections. The result is less disturbance to the water flow inside the duct and a higher operating efficiency of the water propulsion assembly.

DETAILED DESCRIPTION OF A PREFERRED EMBODIMENT

Figure 5:
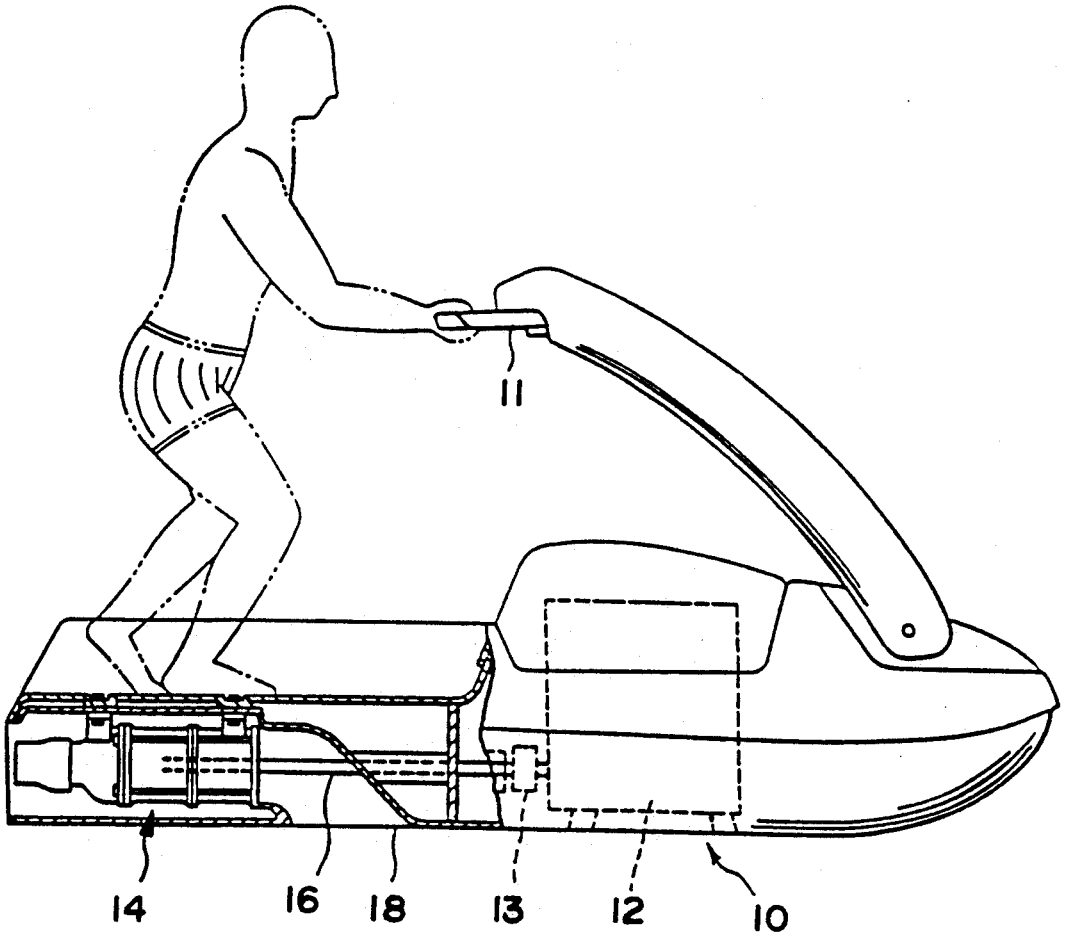
FIG. 5 is a perspective side view of a jet ski-type watercraft incorporating the water jet propulsion assembly of the present invention.

The water jet propulsion assembly of the present invention will now be described with reference to the preferred embodiment shown in FIGS. 5–8. FIG. 5 is an overall view of a jet ski watercraft 10 equipped with water jet propulsion assembly 14 of the present invention. Watercraft 10 includes an engine 12 which is linked by a drive shaft 16 to water jet propulsion assembly 14, located in the rear of watercraft 10. Reference number 11 indicates handlebars and 13 is a coupling which links the output shaft (not labeled) of engine 12 with drive shaft 16. The bottom of watercraft 10 is formed with a water inlet opening 18 through which water enters water jet propulsion assembly 14 as will be described more fully below.

Figure 6:
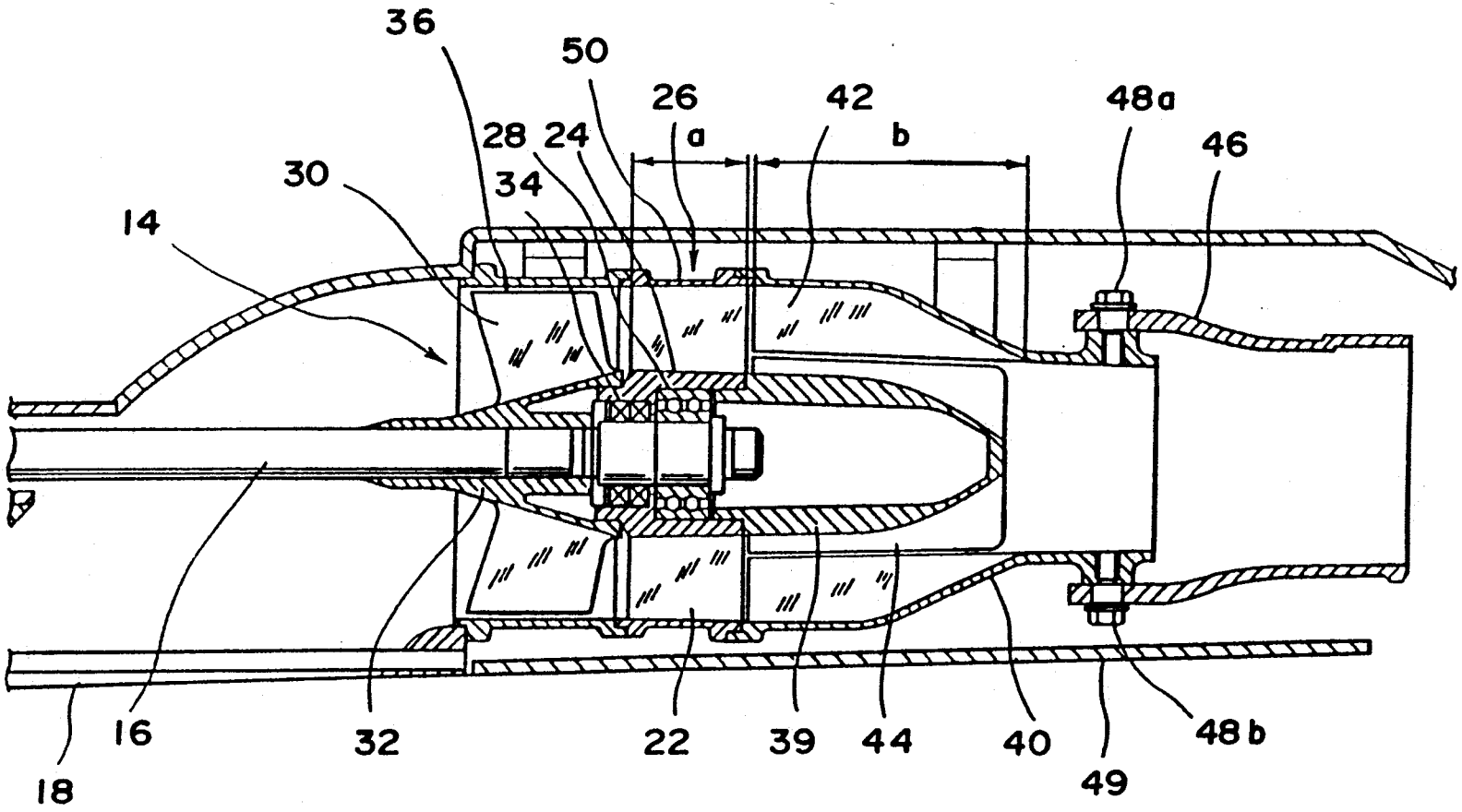
FIG. 6 is a cross-sectional view of a preferred embodiment of the water jet propulsion assembly of the present invention.

FIG. 6 is a detailed mirror-image diagram of the water jet propulsion assembly 14 shown in FIG. 5. Water inlet opening 18 leads to a duct 26 formed within the body of watercraft 10. Duct 26 is defined by an outer duct portion 20 and a concentric inner duct portion 24. Inner duct portion 24 actually constitutes a tube within which drive shaft 16 is rotatably mounted by means of bearings 28. An impeller 30 is threaded onto the end of drive shaft 16 within duct 26 so that it rotates with drive shaft 16. An oil seal 34 is positioned between the impeller 30 and bearings 28 within inner duct portion 24.

Extending radially between inner and outer duct portions 20, 24, adjacent impeller 30, is a first group of sloping vane members 22. In the preferred embodiment, sloping vane members 22 are fabricated by an aluminum die casting method so as to be integral with a central section of duct 26. Sloping vane members 22 are circumferentially spaced about the inner and outer peripheries of inner and outer duct portions 20, 24 respectively.

Reference number 39 denotes a cap fitted on the end of drive shaft 16. Cap 39 is secured to a rear end of inner duct portion 24. Duct 26 is actually constituted by various duct sections including an impeller section 36 within which impeller 30 is located, an intermediate section (not labeled) within which sloping vane members 22 extend and a nozzle section 40 which is radially spaced from and surrounds cap 39. A plurality of straight vane members 42 extend radially inward from an inner circumference of nozzle section 40. Straight vane members 42 are formed integral with nozzle section 40 and extend axially along duct 26 for a predetermined distance approximately equal to the length of cap 39. Furthermore, another group of straight vane members 44 are integrally formed with and extend radially outward from the outer circumference of cap 39, concentric with straight vane members 42. In a manner similar to sloping vane members 22, straight vane members 42 and 44 are preferably equally circumferentially spaced about nozzle section 40 and cap 39 respectively.

Secured to a rear end of nozzle 40 is a deflector 46 which is adapted to be shifted to direct the flow of water in a desired direction so as to steer watercraft 10 either left or right. Deflector 46 is affixed to the end of nozzle section 40 by means of a pair of bolts 48*a*, 48*b*. Reference numeral 49 indicates a part of a cover located on the bottom of watercraft 10 which houses the water jet propulsion unit 14.

In the preferred embodiment, impeller 30 is formed from aluminum. In addition, inner and outer duct portions 20, 24 are also formed from aluminum in order to minimize their weight and to provide adequate strength. Cap 39, nozzle section 40 and deflector 46 are preferably formed from a resin material, while cover 49 which houses water jet propulsion unit 14 is preferably formed from FRP or other reinforced resin materials.

Rotation of drive shaft 16 by engine 12 of watercraft 10 causes impeller 30 to rotate such that water is drawn in through inlet opening 18 and a swirling water stream is created. This water stream passes through duct 26 and out deflector 46 to propel watercraft 10. When the water is caused to flow between the sloping vane members 22, the swirling water is generally straightened into a linear flow. After the water flows through this portion of duct 26, the water will pass by the straight vane members 42 and 44 which assure a linear water flow path. Finally, the water stream is expelled through the rear end of deflector 46.

Figure 1:
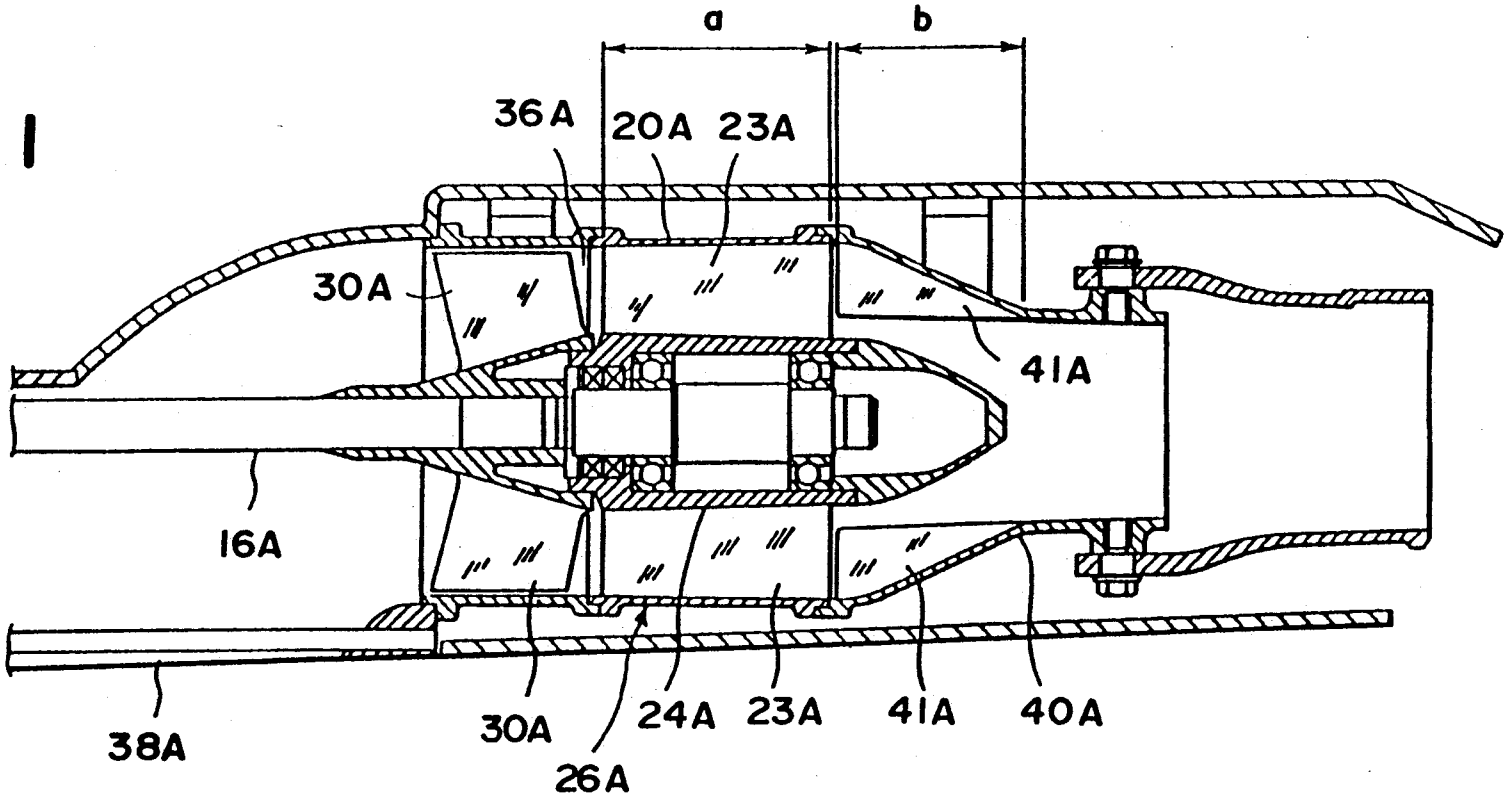
PRIOR ART FIG. 1
FIG. 1 is a cross-sectional view of a water jet propulsion assembly according to the prior art.
Figure 2:
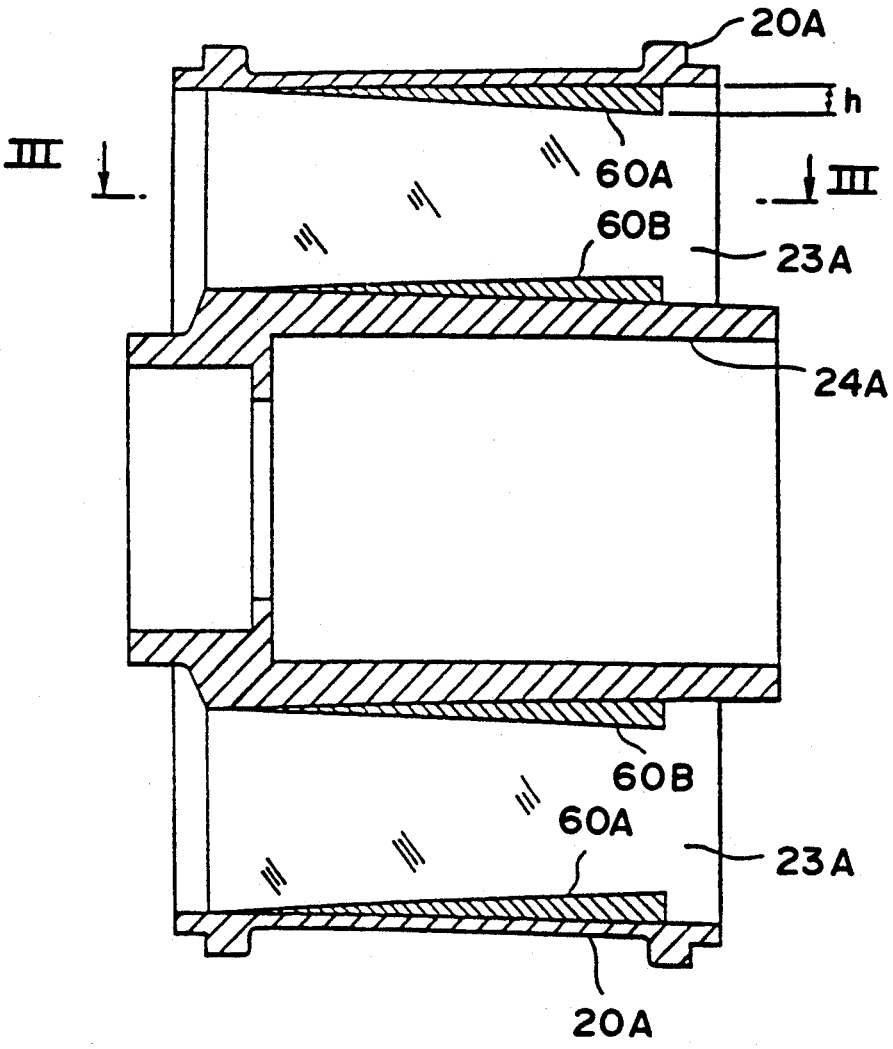
FIG. 2 is an enlarged view of a propulsion assembly of FIG. 1.
Figure 3:
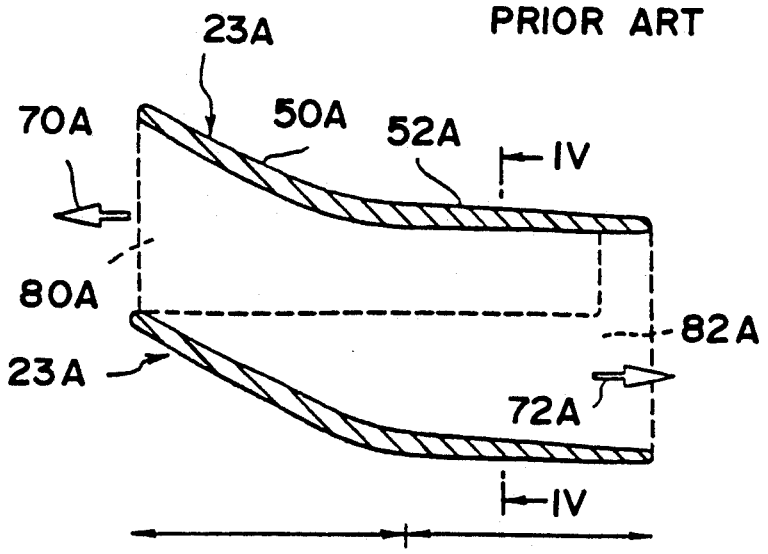
FIG. 3 is a cross-sectional view taken along line III—III of FIG. 2.
Figure 4:
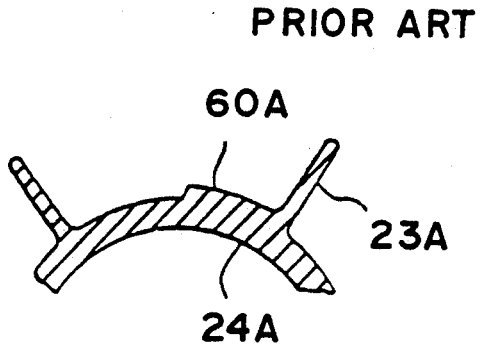
FIG. 4 is a partial, cross-sectional view taken along lines IV—IV of FIG. 3.
Figure 7:
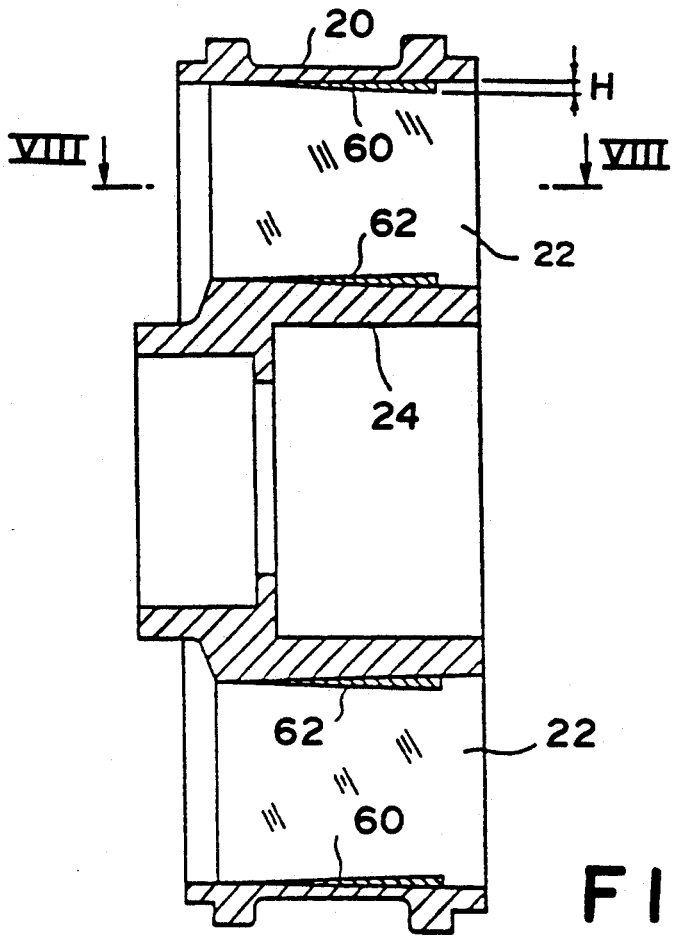
FIG. 7 is an enlarged view of a portion of the water jet propulsion assembly of FIG. 6.
Figure 8:
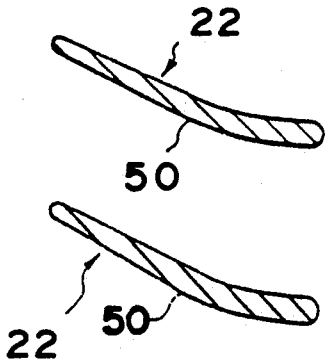
FIG. 8 is a partial, cross-sectional view taken along line VIII—VIII of FIG. 7.

As described above, the straight and sloping portions of the vanes used in the prior art were integrally formed as unit. According to the present invention, however, the sloping vane members 22 are separately formed from straight vane members 42 and 44. As a result, the sloping vane members 22 extend longitudinally a distance shorter than straight vane members 42 and 44, unlike the vane arrangement associated with the prior art as shown in FIG. 1. This feature becomes readily apparent from viewing the distances a and b shown in FIGS. 1 and 6. Forming the sloping vane members 22 separate from the stationary vane members 42, 44 results in a dramatic shortening of the necessary mold removal distance when casting the vanes. As best shown in FIG. 7, the height H of the resulting step 60 on the outside of inner duct portion 20 and the corresponding height of the step 62 formed on the inside surface of inner duct portion 24 is dramatically lower than the corresponding height h of the step associated with the prior art as shown in FIG. 2. Lowering this step height corresponding lowers the amount of turbulence created in the water flow. In practice, it has been found that lowering the step to the height corresponding to that shown in FIG. 7 substantially eliminates the creation of any turbulence in the water flow due to these steps. In addition, the inclusion of straight vane members 44 on the outer circumference of cap 39 provide additional flow rectification capacity of the vanes so as to assure a linear flow into deflector 46.

It should be apparent that the present invention also permits the formation of sloping vane members 22 which are shorter than that associated with the prior art thereby reducing the total weight of the water jet propulsion unit 14 by using less aluminum or other metal in the casings. In addition, the length of drive shaft 16 in the present invention has been shortened as compared to the prior art which further reduces the weight of the watercraft 10 and increases its propulsion efficiency. Finally, only one set of bearings 28 are required to support drive shaft 16 in the present invention, as opposed to the dual bearing arrangement associated with the prior art, which further contributes to less weight and improved efficiency.

Although described with respect to a preferred embodiment of the invention, it should be understood that various changes and/or modifications may be made to the present invention without departing from the spirit of the invention. In general, the invention is only intended to be limited by the scope of the following claims.

I claim:

1. A water jet propulsion assembly comprising:

a longitudinal duct having inlet and outlet openings with the inlet opening located upstream of the outlet opening, said duct including an annular section defined by concentric spaced inner and outer duct portions;

an impeller rotatably mounted within said duct adjacent said inlet opening;

a plurality of vanes extending radially and circumferentially spaced about said duct, said plurality of vanes including a first group of sloping vane members, a second group of straight, longitudinally extending vane members and a third group of vane members, said first and second vane groups being longitudinally separated within said duct and said second and third vane groups being radially separated within said duct; and means for rotating said impeller to cause water to be drawn in said inlet opening and to flow through said duct between said first, second and third vane groups and out said outlet opening.

2. A water jet propulsion assembly as claimed in claim 1, wherein said duct is formed from a plurality of sections secured together, said first and second vane groups being located in different sections of said duct.

3. A water jet propulsion assembly as claimed in claim 1, wherein said means for rotating said impeller includes a drive shaft, said inner duct portion constituting a tube within which said drive shaft is rotatably supported by a single bearing unit.

4. A water jet propulsion assembly as claimed in claim 3, said inner duct portion having a downstream terminal end and including a cap member secured to the terminal end of said inner duct portion and extending toward said outlet opening, said cap member carrying said third group of vane members, said third group of vane members being longitudinally straight, extending radially outwardly from said cap member and being circumferentially spaced.

5. A water jet propulsion assembly as claimed in claim 4, wherein said second and third group of straight vane members are concentrically located within said duct.

6. A water jet propulsion assembly as claimed in claim 1, wherein said first group of sloping vane members extends longitudinally within said duct a distance less than said second group of straight vane members.

7. A water jet propulsion assembly as claimed in claim 1, wherein said first group of sloping vane members are disposed upstream of said second group of straight vane members.

* * * * *